United States Patent [19]

Mori

[11] 4,050,391

[45] Sept. 27, 1977

[54] BUTTONHOLE STITCHING DEVICE FOR ZIGZAG SEWING MACHINE

[76] Inventor: Katsuji Mori, 12-2, Chidori-cho 3-chome, Ogaki, Gifu, Japan

[21] Appl. No.: 664,855

[22] Filed: Mar. 8, 1976

[30] Foreign Application Priority Data

Mar. 12, 1975 Japan ..... 50-30476

[51] Int. Cl.[2] ..... D05B 3/24

[52] U.S. Cl. ..... 112/77

[58] Field of Search ..... 112/77, 70, 65, 158 B, 112/160, 102

[56] References Cited

U.S. PATENT DOCUMENTS

| | | | |
|---|---|---|---|
| 2,405,253 | 8/1946 | Hickey | 112/77 |
| 2,927,547 | 3/1960 | Enos | 112/77 |
| 3,121,410 | 2/1964 | Enos | 112/77 |
| 3,132,611 | 5/1964 | Nickerson et al. | 112/77 |
| 3,651,773 | 3/1972 | Rakacs | 112/77 |
| 3,669,044 | 6/1972 | Adams et al. | 112/77 |

*Primary Examiner*—H. Hampton Hunter
*Attorney, Agent, or Firm*—Irvin A. Lavine

[57] ABSTRACT

A buttonhole stitching device for a zigzag sewing machine, the buttonhole stitching device having a forked member which is arranged on a base plate. The forked member consists of a forked front portion which forms a long notch having a width corresponding to the amplitude of movement of a sewing machine needle and a rear portion provided with a shroud frame wall defining a nearly rectangular aperture. The base plate is provided with a hook at its front edge which is fitted into the long notch of the forked member and the forked member reciprocally moves along the base plate under the guidance of the hook provided thereto. A cam plate is removably fitted into a walled or framed aperture formed on the base plate, and the cam plate is provided with a loop channel surrounded by a rack at the under surface thereof. The shape of the loop channel corresponds to the shape of a buttonhole to be stitched. A rotative axis is arranged to penetrate the center portion of the base plate and the upper end of the rotative axis extends into the loop channel of the cam plate. A pinion is fixed to the upper portion of the axis and is engaged with the rack of the cam plate, while a ratchet is attached to the lower portion of the axis beneath the base plate so as to rotate the axis in cooperation with the up-and-down movement of the sewing machine needle. Therefore, when the sewing machine needle is axially and reciprocally moved, the pinion rotates so that the forked member moves forward and backward and also swings horizontally with the hook of the base plate as the central point. A cloth presser is pivotably connected to the extreme points of the forked member and is moved along the buttonhole formed on the cloth.

4 Claims, 11 Drawing Figures

BUTTONHOLE STITCHING DEVICE FOR ZIGZAG SEWING MACHINE

This invention relates to a device to be attached to a zigzag sewing machine for stitching buttonholes made in cloth in cooperation with the movement of a sewing machine needle.

It is an object of this invention to provide an improved buttonhole stitching device.

It is another object of this invention to provide a buttonhole stitching device of small-sized and simple in construction.

According to this invention, there is provided a buttonhole stitching device to be attached to a zigzag sewing machine, the buttonhole stitching device comprising a forked member consisting of a forked front portion forming a long notch and a rear portion provided with a shroud frame defining a nearly rectangular aperture, the long notch having a width which corresponds to the amplitude of movement of a sewing machine needle, a base plate on which the forked member is arranged to be reciprocally moved, the base plate having a hook at its front edge which is fitted into the notch of the forked member, a rotative axis to which a pinion is fixed at the upper portion thereof, the axis penetrating the central portion of the base plate, driving means attached to the rotative axis beneath the base plate so as to rotate the axis in cooperation with the up-and-down movement of the sewing machine needle, a cam plate removable fitted into the framed or walled aperture, the cam plate including a loop channel, the shape of which corresponds to the shape of a buttonhole to be stitched, and a rack surrounding said loop channel and engaging with the pinion, and movable cam plate retaining means for preventing the cam plate from coming out of the framed or walled aperture of the forked member.

The invention will now be described in further detail by way of example with reference to the accompanying drawings, in which.

Figure 1:
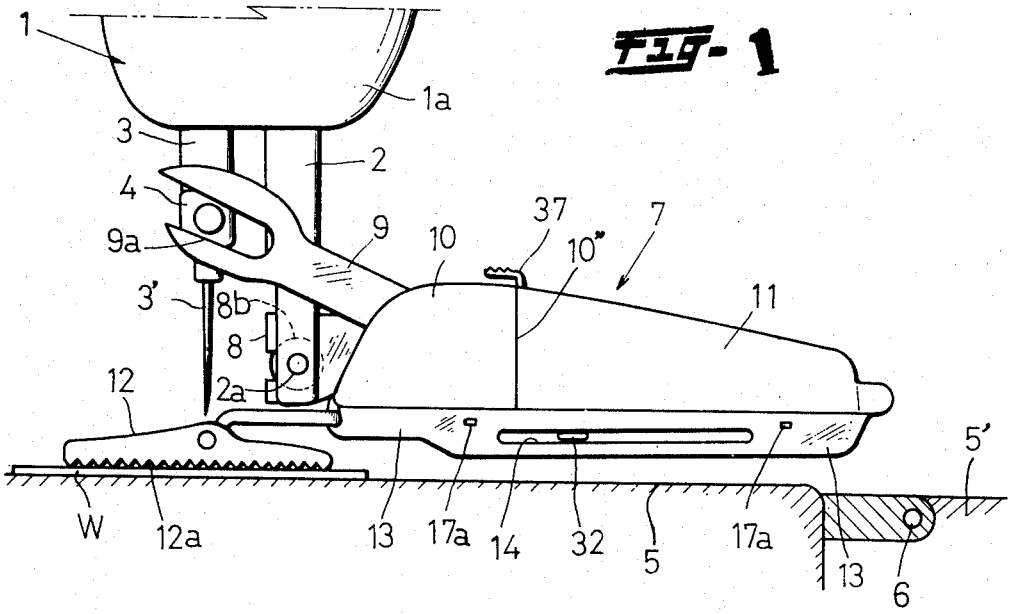
FIG. 1 is a side elevational view of a prefered embodiment of the device according to this invention, attached to a zigzag sewing machine.
Figure 2:
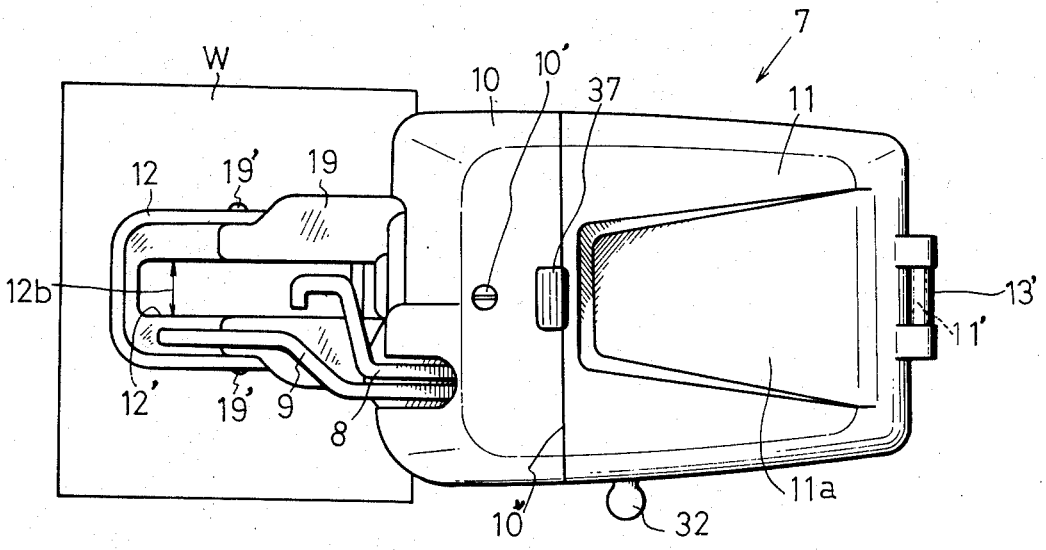
FIG. 2 is a plan view of the device shown in FIG. 1.
Figure 3:
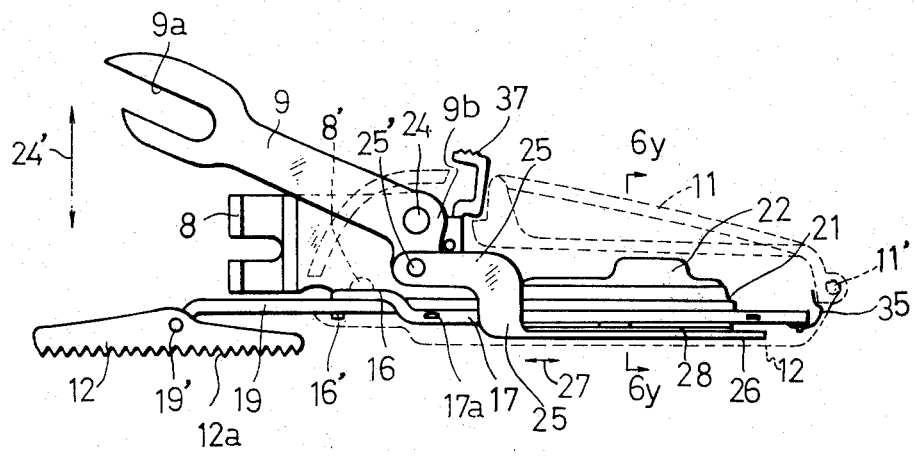
FIG. 3 is a side elevational view of the device shown in FIG. 1 with parts removed.

Referring now to the drawings in more detail, there is generally shown a buttonhole stiching device 7 according to this invention which is attached to a zigzag sewing machine 1. Numerals 1*a*, 2, 3, 3′ and 4 indicate a sewing machine arm, a presser bar, a needle bar, a sewing machine needle and a needle clamp screw, respectively. Numeral 5 indicates a feed plate of the sewing machine, and numeral 5′ indicates a sewing table to which the sewing machine is attached by means of hinges 6. The buttonhole stitching device 7 is attached to the presser bar 2 of the sewing machine by means of a member 8 which engages the buttonhole stitching device 7. Numeral 9 indicates a lever pivotally attached to the buttonhole stitching device 7, and this lever 9 cooperates with the movement of the needle bar 3 of the sewing machine. For the purpose of engagement with the needle clamp screw portion 4 of the needle bar 3, the lever 9 is provided with a notch 9*a* on the outer edge thereof.

Figure 4:
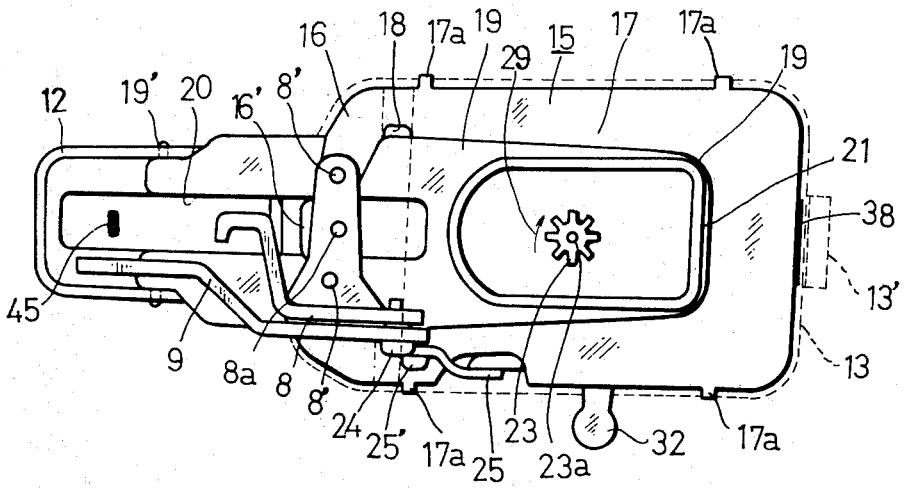
FIG. 4 is a plan view of the device shown in FIG. 3 with parts removed.
Figure 5:
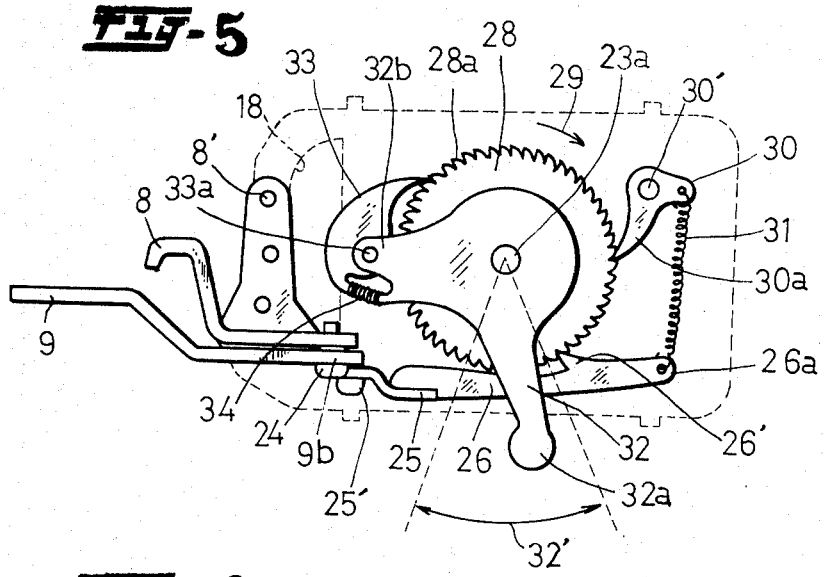
FIG. 5 is a plan view of the device with parts removed showing the driving means thereof.
Figure 6:
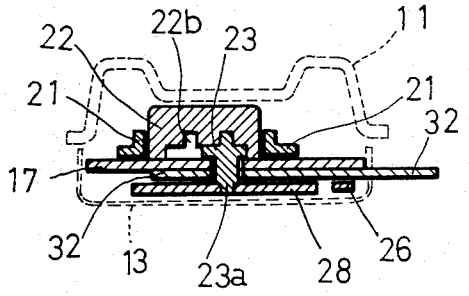
FIG. 6 is a transverse cross-sectional view taken along the line 6*y* -6*y* of FIG. 3.

The buttonhole stitching device is covered with a front cover 10 and a rear cover 11. THe front cover 10 is fixed to the device by a screw 10′, while the rear cover 11 is arranged to be openable. These two covers 10 and 11 are is engaged along line 10″. Numeral 12 indicates a means for pressing a cloth W and this means 12 possesses teeth 12*a* on the under surface thereof and is provided with a slot 12′ having a width 12*b* which corresponds to the amplitude of movement of the sewing machine needle 3′. The buttonhole stitching device 7 is further covered with a bottom cover 13 having a slot 14 at a flank thereof from which a lever 32, which will be described in more detail hereinafter, protrudes and this lever 32 is pivotally movable along the slot 14. Numeral 15 indicates a base plate of the device consisting of a front part 16 and a rear part 17. The front part 16 of the base plate 15 is upwardly bent so as to be offset from and parallel to the rear part 17 of the base plate 15 and is provided with an aperture 18 at the bent portion. To the front part 16 of the base plate 15 there is fixed the aforementioned member 8 by rivets 8′, 8′. The rear part 17 of the base plate 15 is provided with a pair of projections 17*a*, 17*a* on each flank thereof with which the buttom cover 13 is engaged. The aforementioned cloth presser 12 is pivotally connected to a forked member 19 with a pair of pins 19′, 19′ formed on the front edges of the forked portions of the member 19. There is formed a long notch 20 between the forked portions of the member 19, and this notch 20 has a width 20′ see FIG. 9, which is equal to the width 12*b* of the slot 12′ of the cloth pressure 12. On the rear flat portion of the member 19 there is provided an upstanding shroud frame wall 21 defining a nearly rectangular aperture into which a cam 22 is removably fitted. The rear portion of wall 21 is straight, as shown in FIG. 4. The cam 22 is provided with a loop channel 22*b*, the shape of which corresponds to the shape of a buttonhole, surrounded with a rack 22*a*. The cam 22 may be prepared to have different types of racks according to the shape of buttonholes. The member 19 is inserted into the aperture 18 of the base plate 15. The center portion of the front edge of the base plate 15 is downwardly bent to form a guide hook 16′ with which the notch 20 of the member 19 is engaged, so that the member 19 reciprocally moves along the notch 20 under the guidance of the hook 16′.

Numeral 23 designates a pinion which is fixed to a rotative axis 23*a* penetrating the rear part 17 of the base plate 15 at its central portion. The upper end of the axis 23*a* is fitted into the channel 22*b* of the cam 22, while the pinion 23 fixed to the axis 23*a* is engaged with the rack 22*a* in the cam 22. Under the base plate 15, a ratchet 28 is attached to the lower end or the axis 23*a*. The axial reciprocal movement of the sewing machine needle 3' is transmitted to the ratchet 28 through the lever 9 and a slender flat member 26 having a claw 26'. The member 26 also has an upwardly bent portion 25 which is connected to the rear end 9b of the lever 9 by a pin 25', and the rear end 9b of the lever 9 is rotatably supported by an axis 24 fixed to the rear end of the member 8. According to the vertically reciprocal movement of the sewing machine needle 3' and the member 8, the slender flat member 26 reciprocates in the direction of an arrow 27, so that as the claw 26' of the member 26 is engaged with teeth 28b of the ratchet 28, the ratchet 28 rotates pitch in the direction of an arrow 29 and the rotation of the ratchet 28 is transmitted through the axis 23a to the pinion 23.

Numeral 30 indicates a pawl for preventing the ratchet 28 from turning back, and this pawl 30 is rotatably supported by a pin 30' fixed to the base plate 15 and is connected to an end 26a of the member 26 by a tension spring 31 which effects the engagement of the teeth 28a of the ratchet 28 and a tip 30a of the pawl 30. A hand lever 32 is rotatably attached to the axis 23a above the ratchet 28 and this lever 32 includes a grip portion 32a which protrudes from the slot 14 provided in the bottom cover 13 and is movable along the slot 14. The lever 32 also includes an arm 32b to which a pawl 33 is attached by a pin 33a. A free end of the pawl 33 is connected to the arm 32b of the lever 32 by means of a coil spring 34 so that the tip of the pawl 33 is forced to engage with the teeth 28a of the ratchet 28. Therefore, by manually operating the lever 32 in the direction of an arrow 32', the pawl 33 engaged with the teeth 28a of the ratchet 28 forces the ratchet 28 to rotate in the direction of an arrow 29 through a desired angle. While, the pinion 23 rotates along with the ratchet 28 so as to move the cam 22 as well as the forked member 19 along the base plate 15. Thus, a desired position where the buttonhole stitching may be started is set.

Figure 8:
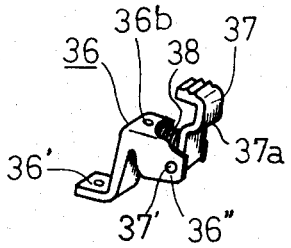
FIG. 8 is a perspective view of a cover locking means.
Figure 7:
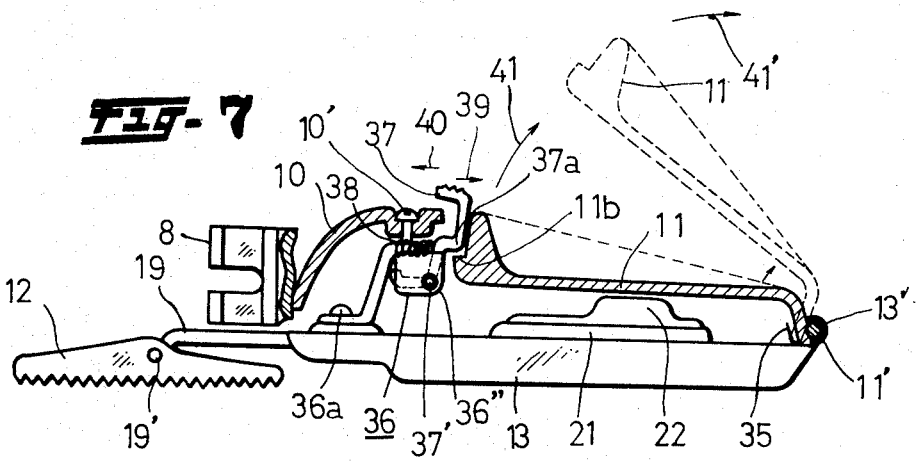
FIG. 7 is a longitudinal partially sectional view of the device showing how to open and close the cover of the device.

As mentioned hereinbefore, the rear cover 11 is openable. The cover 11 is provided with a rod-shaped portion 11' at the rear edge thereof which is supported by a bearing 13' formed en bloc with the rear edge of the botton cover 13. Further, the rear end of the cover 11 is urged upwardly by a leaf spring 35 attached to the rear edge of the base plate 15. Numeral 36 see FIG. 8, designated a cover locking member, the lower end of which designated by the numeral 36' is fixed to the front part 16 of the base plate 17 by a screw 36a which is driven into a tapped hole 8a provided to the fixed portion of the member 8. A tapped hole 36b is provided to the upper portion of the member 36, and the screw 10' is driven into the hole 36b so as to fix the front cover 10. The member 36 further includes a portion 36'' to which a rear cover stopper 37 is pivotally connected by a pin 37', and this stopper 37 is always urged in the direction of an arrow 39 by a coil spring 38 attached to the upper portion of the member 36. The stopper 37 has a hook portion 37a which engages with a step 11b provided to the front end of the rear cover 11, so that the rear cover 11 is firmly locked when it is closed. In the closed condition of the rear cover 11, the cam 22 is prevented from slipping out of the shroud frame 21 by a depression 11a formed on the rear cover 11, which thereby functions as a retainer.

It is necessary to quickly open the rear ocver 11 in case of replacing the cam 22 with another one of different type. By pushing the stopper 37 in the forward direction of an arrow 40, the cover 11 is unlocked and at the same time is sprung up in the direction of an arrow 41 by the leaf spring 35, with the rod-shaped portion 11' formed on the rear edge of the cover 11 being supported by the bearing 13' provided by the bottom cover 13. Then, the cover 11 may easily be opened fully by hand in the direction of an arrow 41'.

As mentioned hereinbefore, the hook 16' formed on the center portion of the front edge of the front part 16 of the base plate 15 is fitted into the notch 20 of the member 19. Inasmuch as the cam 22 fitted into the aperture defined by the shroud frame 21 is moved by the pinion 23, the member 19 is relatively moved along the notch 20 under the guidance of the hook 16' in an arch indicated by of an arrow 42, and also swings in the direction arrow 43, with the hook 16' of the base plate 15 as the central point or guide. On this occasion, as the lowest edge of the hook 16' is positioned above the cloth presser 12, the rear part of the presser 12 can be moved backward beneath the hook 16', accordingly the range designated by the numeral 44 within which the member 19 reciprocally moves overlaps the range designated by the numeral 46 within which the cloth presser 12 moves relatively to a position 45 to which the needle 3' goes down. The overlapping range is designated by the numeral 46'. Due to the arrangement of the overlapping range 46', the length of the member 19 is set remarkably shorter than a customary one, accordingly the whole structure of the buttonhole stitching device is made small.

In the operation of the device as hereinabove described, the cover 11 is opened by pushing the stoper 37 in the forward direction so as to fit a cam 22 having rack 22a, the shape of which corresponds to the shape of a buttonhole to be stitched, into the aperture defined by the frame wall 21, and after engaging the rack 22a with the pinion 23 the retaining cover 11 is closed. Next, the presser bar 2 of the sewing machine 1 is raised so that the notch 9a of the lever 9 is engaged with the needle clamp screw portion 4 of the needle bar 3, while the member 8 of the device is attached to the pressure bar 2 by means of a screw 8b which is driven into a hole 2a provided to the presser bar 2. Thus, the buttonhole stitching device 7 is attached to the sewing machine 1. Then, a cloth W having a buttonhole to be stitched is placed on the feed plate 5 of the sewing machine and the presser bar 2 is lowered to press the cloth W with the teeth 12a of the cloth presser 12. Then, the hand lever 32 is rotated forward and backward to move the pawl 33 engaged with the teeth 28a of the ratchet 28, so that the ratchet 28 is rotated in the direction of the arrow 29 and simultaneously the pinion 23 is rotated in the same direction, inasmuch as the pinion 23 is connected to the ratchet 28 through the axis 23a. Accordingly, the cam 22 is moved forward or backward and correspondingly to the movement of the cam 22 the member 19 moves relatively to the base plate 15. Thus, a starting point for stitching the buttonhole of the cloth W is set.

Under this condition, the sewing machine 1 is operated to effect the up-and-down movement of the needle 3' as well as the zigzag movement thereof. Accordingly, the lever 9 is moved up and down in cooperation with the needle 3'. Inasmuch as the lever 9 is connected to the member 26 having the claw 26' through the bent portion 25 thereof, the member 26 is reciprocated so that the claw 26' of the member 26 engaged with the teeth 28a of the ratchet 28 rotates the ratchet in the direction of the arrow 29 and simultaneously rotates the pinion 23 in the same direction. When the pinion 23 is rotated, the cam 22 including rack 22a therein which is engaged with the pinion 23 moves the member 19 as well as the cloth presser 12 attached thereto in accordance with the shape of the rack 22*a* so as to effect the zigzag stitching of the buttonhole.

Figure 9:
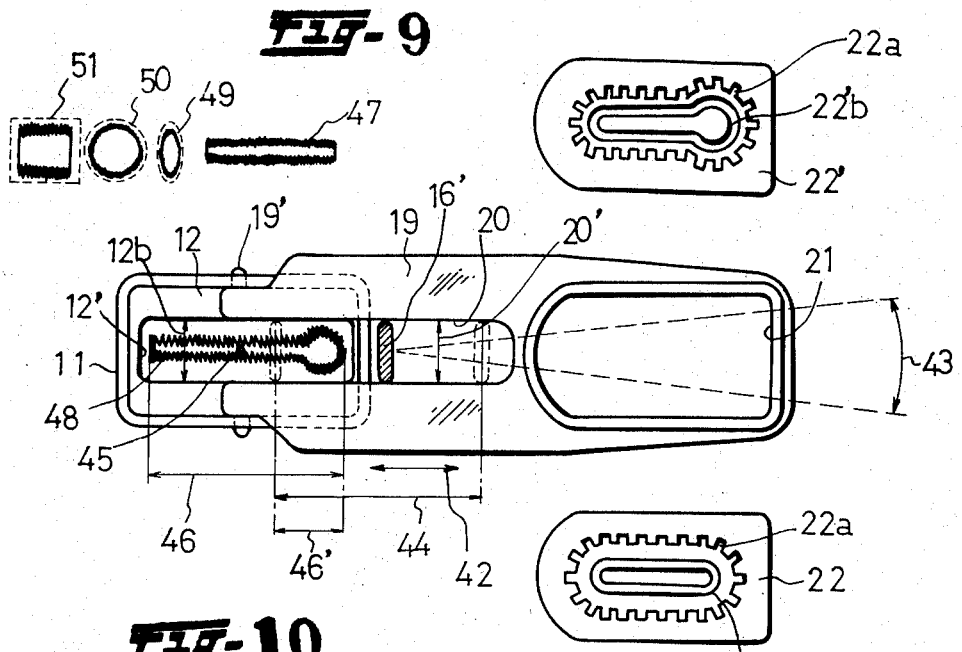
FIG. 9 is a plan view of the forked member to which the cloth presser is attached, and shows different types of cam plates as well as various kinds of stitching which may be carried out.
Figure 10:
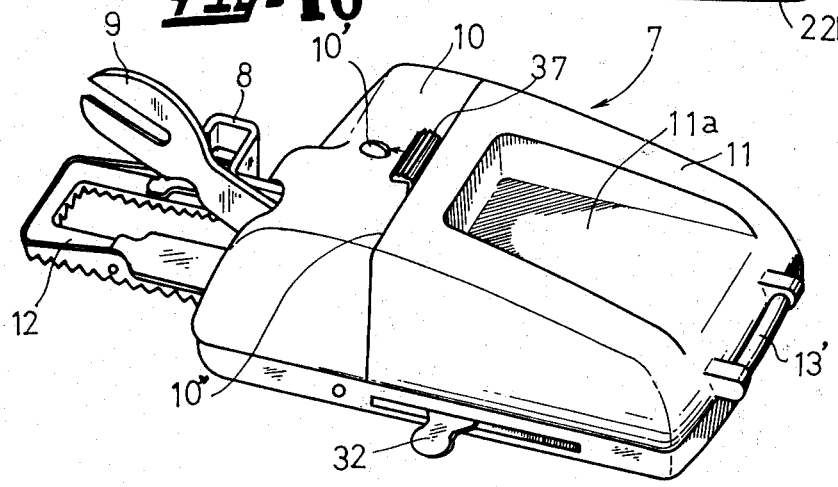
FIG. 10 is a perspective view of the device according to this invention.
Figure 11:
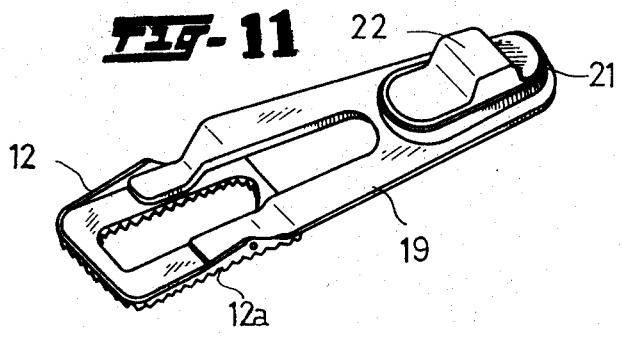
FIG. 11 is a perspective view of the forked member including the cloth pressure and the cam plate.

In case of using the cam as shown by 22 in FIG. 9, the ordinary buttonhole stitching as shown by the numeral 47 is carried out, while in case on using a cam designated by the numeral 22', stitching of a buttonhole having a circle at an end portion thereof can be carried out, as indicated by the numeral 48. Further, using different types of cams if necessary, various kinds of stitching such as shown for example at 49, 50 and 51 in FIG. 9 can be carried out.

It will be understood that many of the details described and illustrated could be varied without necessarily departing from the spirit and scope of the invention as expressed in the appended claims.

What I claim is:

1. A buttonhole stitching device to be attached to a zigzag sewing machine, the bottonhole stitching device comprising:

a forked member consisting of a forked front portion forming a long notch and a rear portion provided with an upstanding shroud frame wall defining a nearly recatangular aperture, said long notch having a width which corresponds to an amplitude of a laterally moving sewing machine needle;

a base plate, said forked member in facing contact with said base plate for sliding movement relative thereto, said base plate having guide hook means at its front edge which extends into said notch of said forked member for guiding said forked member in reciprocating and swinging movement;

a rotative axis to which a pinion is fixed at the upper portion thereof, said axis penetrating the central portion of said base plate;

driving means attached to said rotative axis beneath said base plate so as to rotate said axis in cooperation with the up-and-down movement of said sewing machine needle;

a cam plate removably fitted into said walled aperture, said cam plate including a loop channel, the shape of which corresponds to the shape of a buttonhole, and a rack surrounding said loop channel and engaging with said pinion; and cam plate retaining means for preventing said cam plate from being dislocated from said framed aperture of said forked member and selectively movable between a first position preventing said movement of said cam plate and a second position permitting said movement of said cam plate.

2. The invention as defined in claim 1 wherein said base plate comprises:

a bent portion adjacent to said guide hook means; and an aperture in said bent portion, said forked member extending through said aperture.

3. The invention as defined in claim 1 wherein said cam plate retaining means comprises:

a bottom cover having a hinge at the rear end thereof;

an openable cover having the rear end thereof pivotably connected to said hinge; and means for locking said openable cover when closed.

4. The invention as defined in claim 1, wherein said upstanding shroud frame wall defining said aperture includes a straight rear wall portion.

* * * * *